United States Patent [19]

Montgomery et al.

[11] Patent Number: 4,979,648

[45] Date of Patent: Dec. 25, 1990

[54] CHILD RESISTANT PUSH-PULL DISPENSING CLOSURE

[75] Inventors: Gary V. Montgomery, Evansville, Ind.; Alexander Mark, Passaic, N.J.

[73] Assignee: Sunbeam Plastics Corporation, Evansville, Ind.

[21] Appl. No.: 387,489

[22] Filed: Jul. 31, 1989

[51] Int. Cl.[5] ..... B67D 5/00

[52] U.S. Cl. ..... 222/153; 222/522; 222/525; 215/201

[58] Field of Search ..... 222/153, 521, 522, 525; 215/220, 225, 201

[56] References Cited

U.S. PATENT DOCUMENTS

| | | | |
|---|---|---|---|
| 378,260 | 1/1874 | Kessler . | |
| 3,430,796 | 3/1969 | Berg | 215/225 X |
| 3,656,645 | 4/1972 | Fontenelli | 215/225 |
| 3,695,476 | 10/1972 | Ruekberg | 215/225 X |
| 3,828,981 | 8/1974 | Linkletter . | |
| 3,858,740 | 1/1975 | Lestaevel | 215/225 X |
| 3,885,712 | 5/1975 | Libit . | |
| 3,981,421 | 9/1976 | McDonald et al. | 222/521 |
| 4,180,173 | 12/1979 | Diaz | 222/153 X |
| 4,253,588 | 3/1981 | Lester et al. . | |
| 4,314,656 | 2/1982 | Kessler . | |
| 4,358,031 | 1/1982 | Lohrman . | |
| 4,739,906 | 4/1988 | LoTurco . | |
| 4,747,103 | 6/1988 | Barriac . | |
| 4,927,065 | 5/1990 | Beck | 222/525 X |

FOREIGN PATENT DOCUMENTS

| | | | |
|---|---|---|---|
| 2121739 | 11/1972 | Fed. Rep. of Germany | 215/220 |
| 2603872 | 4/1988 | France | 215/220 |

*Primary Examiner*—Andres Kashnikow
*Assistant Examiner*—W. Todd Waffner
*Attorney, Agent, or Firm*—Gifford, Groh, Sprinkle, Patmore and Anderson

[57] ABSTRACT

A push-pull dispensing closure for a container includes a child-resistant sleeve which is slidably retained between the closure dispensing cap and the closure base member. In its NORMAL position, the sleeve obstructs opening access to the cap. When the sleeve is pushed toward the base member to a READY position, the cap can be gripped for opening movement. The sleeve is molded with a resiliently deformable plastic into which a return force is introduced as the sleeve is pushed toward ists READY position.

25 Claims, 3 Drawing Sheets

CHILD RESISTANT PUSH-PULL DISPENSING CLOSURE

This invention relates to container closures and more particularly to child-resistant dispensing closures.

There is a variety of dispensing closures in which a base member is attached to a container neck by threading, or by a snap head which employ a cap which is moved relative to the base to open and close a dispensing orifice located in the cap. A well-known and widely used version of this type of dispensing closure is the push-pull closure in which a cap having a dispensing orifice in its end slides over a discharge nozzle on a base member. A plug is held in spaced relationship to the nozzle so that as the cap is pushed toward the base member the plug closes off the dispensing orifice in the cap. As the cap is pulled away from the base member, the orifice is opened for dispensing a flowable product. The cap or dispensing head normally has a flange near its top or is button-shaped, allowing the cap to be easily gripped by the user's fingers for pulling the cap open. The cap is held captive on and seals to the base member nozzle by the use of beads or projections in a well-known manner.

As with all child-resistant closures, a balance must be reached between the efficacy of the safety feature and the relative ease with which an adult can open the closure. The popularity of the push-pull dispenser lies in the ease in which the closure can be opened and closed with a simple one or two hand operation. Child-resistant features which detract from this operating simplicity cause the acceptance of the closure to suffer obvious consequences. Childproofing attempts which cover the entire closure and thus obscure the fact that the closure is of the push-pull type are not commercially successful. Likewise, locking mechanisms which require diverse movements apparently have not been successful for the same reason.

The present invention is directed to a new child-resistant dispensing closure of the push-pull type in which the simplicity of the push-pull closing and opening is not obscured or impaired by a child-resistant locking feature requiring a different type of motion, such as squeezing or rotating. Also, the child-resistant feature does not require increased or excessive forces in performing these normal opening and closing functions.

The push-pull dispensing closure of this invention includes a base member which has means for attachment to a container. A cap having a dispensing orifice is retained on the base member and is movable axially relative to the base from a closed position to an open dispensing position, permitting flow through the orifice. A child-resistant sleeve is coaxially mounted relative to and held captive between the base member and the cap. The sleeve is axially movable relative to both the base member and the cap from a NORMAL position, blocking access to the cap to a READY position providing access to the cap for movement of the cap to the open dispensing position. The child-resistant sleeve is held in its NORMAL position by resiliently biasing the sleeve towards this position when it is moved towards the READY position.

The sleeve is molded with a resiliently deformable plastic material, and when the sleeve is moved relative to the base member by pushing the sleeve towards the base member, moving it from its NORMAL position towards its READY position, the base member causes deformation of the sleeve, resiliently biasing the sleeve towards its NORMAL position. This elastic deformation of the sleeve is effected by the selection of the relative configurations of the contacting surfaces of the sleeve and base member. For example, the base member can have an upstanding frusto-conical section which contacts the inside diameter of a cylindrical portion of the sleeve. When the sleeve is pushed downwardly over the frusto-conical portion of the base, the sleeve expands outwardly creating a resilient return force. Alternatively, an upstanding portion of the base member can be cylindrical for coaction with a frusto-conical portion of the sleeve. The sleeve can be slotted to provide ease in flexing the sleeve as it being moved from its NORMAL position towards its READY position over the contacting base member.

The sleeve can have an inwardly directed bead projecting from its cylindrical portion which snaps over the cap skirt when the sleeve has been moved from its NORMAL position towards its READY position so that an opening force is applied to the cap by the sleeve when the sleeve is released.

With a cylindrical sleeve, a radially outwardly directed flange can be provided at the bottom of the sleeve against which the user can exert a downward force in moving the sleeve from its NORMAL position to its READY position exposing the dispensing cap for pulling it to its open position.

In another embodiment utilizing a cylindrical sleeve and an outwardly directed flange at the bottom of the sleeve, integrally molded downwardly extending leaf spring members can be provided on the flange to coact against a generally flat portion of the base member to provide the resilient biasing of the sleeve towards its NORMAL position when the sleeve is moved towards its READY position.

Other variations within the scope of this invention will become more apparent by an examination of the drawings and the description which follows.

The preferred embodiments of the invention are illustrated in the drawings in which:

FIGS. 1–8 show embodiments of the closure of this invention in which a generally cylindrical portion of a child-resistant sleeve coacts with a generally tapered portion of a base member to introduce a resilient return force in the sleeve as it is being moved from a NORMAL position blocking access to a dispensing cap to a READY position permitting movement of the cap to its open dispensing position;

Figure 1:
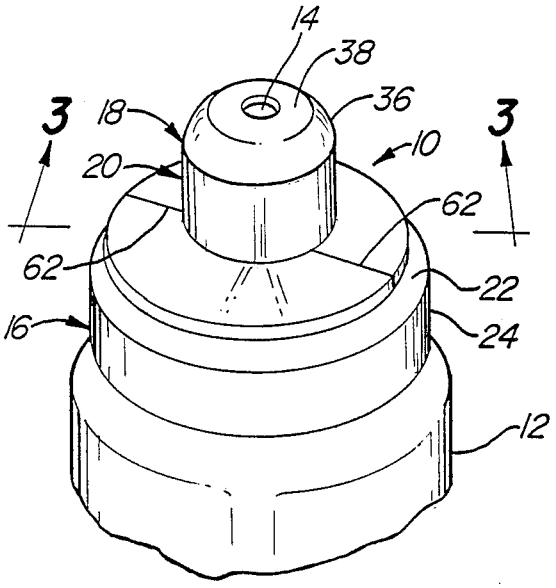
FIG. 1 is a perspective view of the push-pull dispensing closure of this invention in a closed position with its child-resistant sleeve in its NORMAL position blocking access to the cap for movement to a dispensing position; the closure is shown attached to a container neck.
Figure 2:
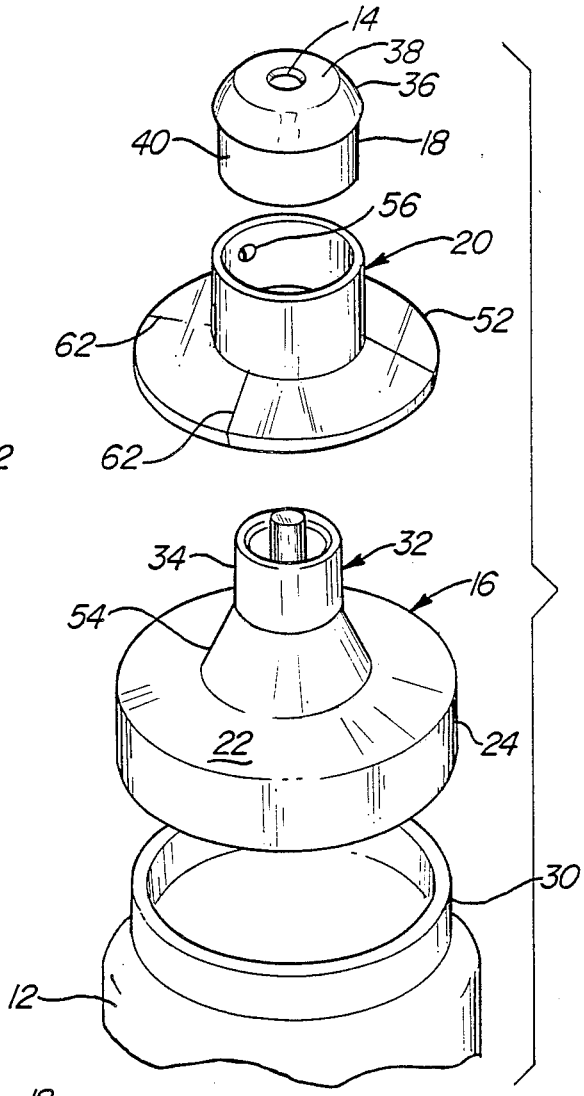
FIG. 2 is an exploded perspective view of the closure of this invention shown in FIG. 1 showing the sequence of assembly of the closure and attachment of the closure to a container neck, and further showing the child resistant sleeve confined for movement between the closure base and its closure dispensing cap.
Figure 3:
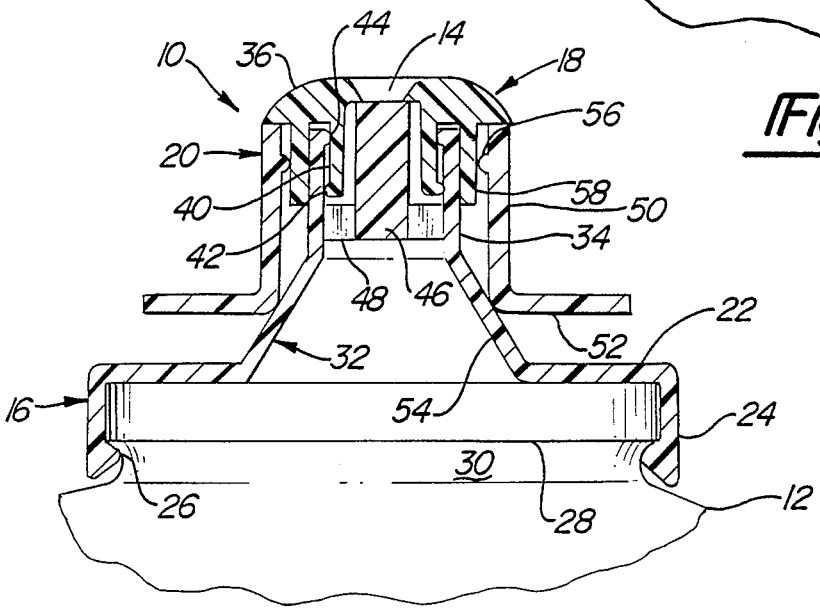
Figure 4:
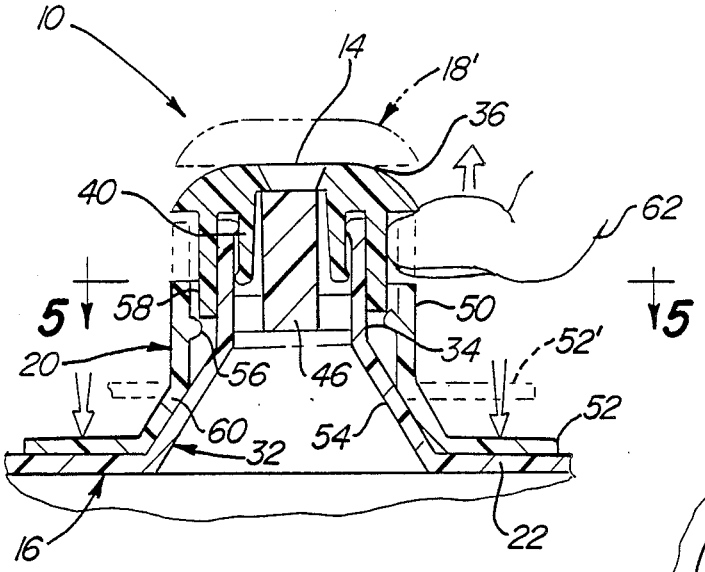
Figure 5:
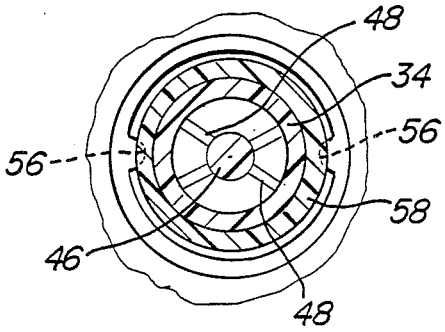
Figure 6:
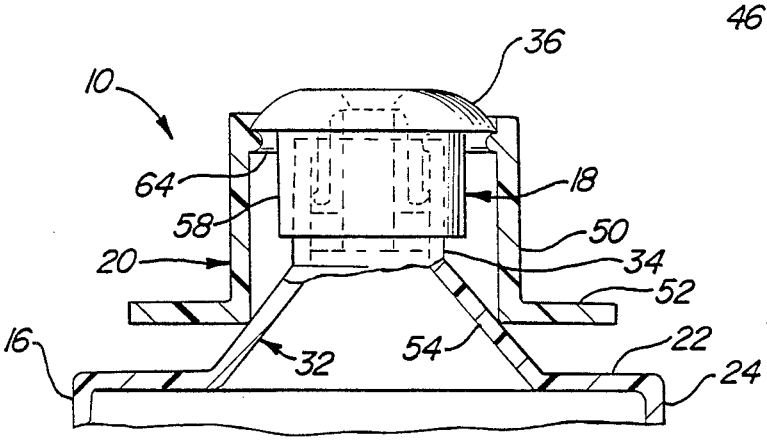
Figure 7:
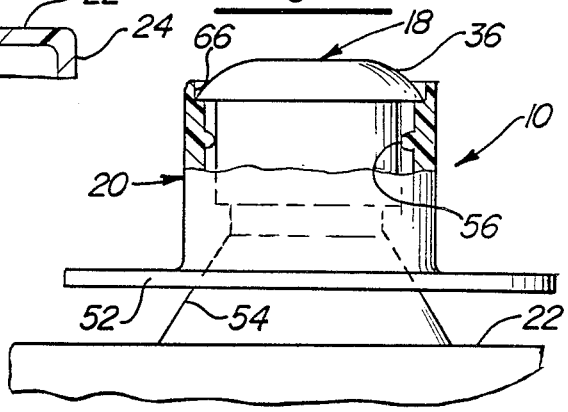
Figure 8:
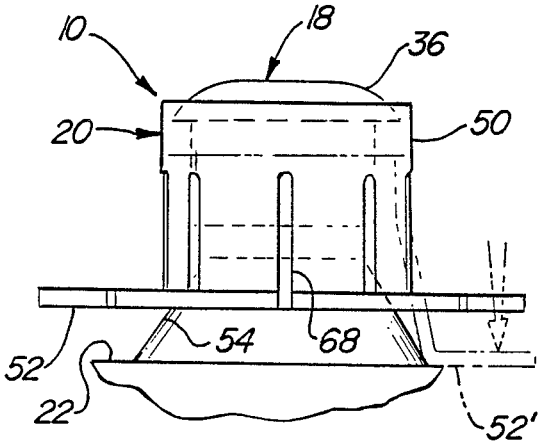
Figure 9:
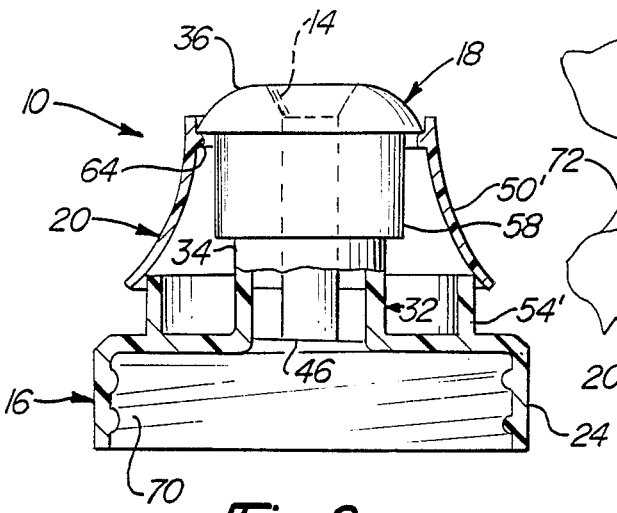
Figure 10:
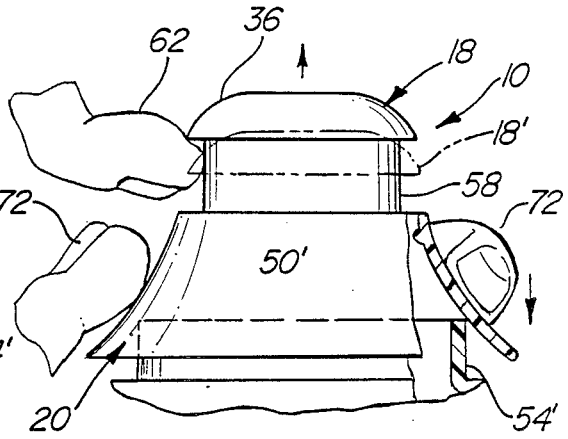
Figure 11:
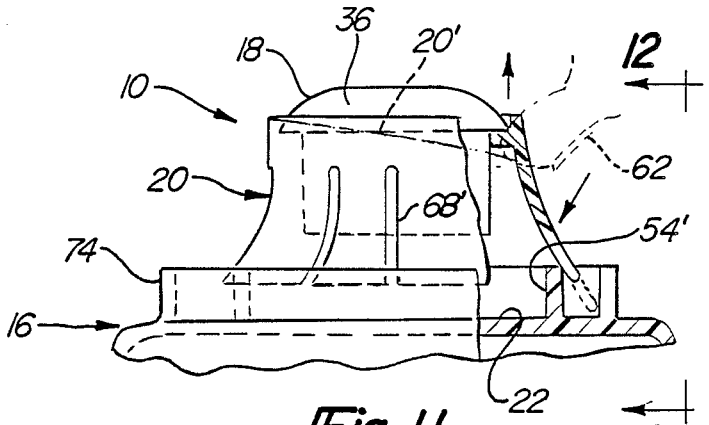
Figure 12:
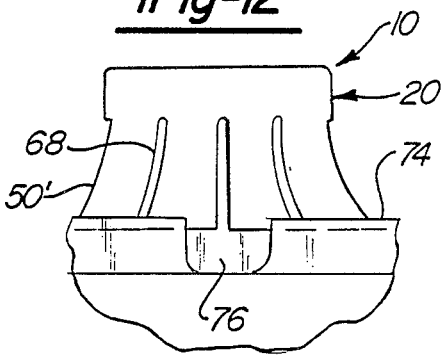
Figure 13:
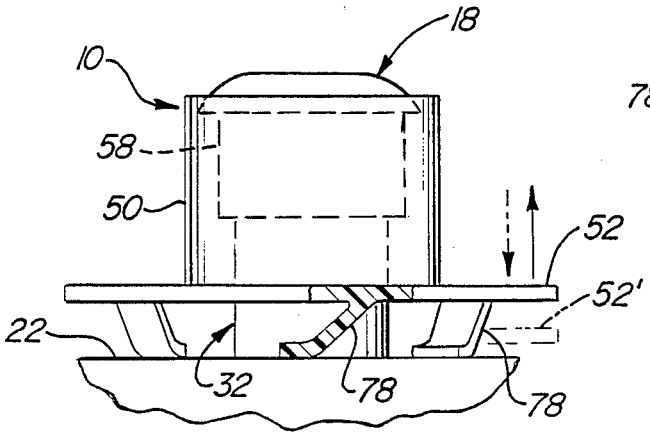
Figure 14:
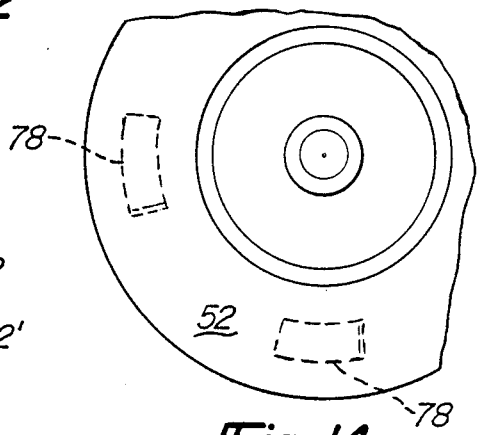

FIG. 3 is a cross-sectional elevational view of the closure of FIGS. 1 and 2 attached to a containeer by a snap bead connection and showing the details permitting relative movement of the dispensing cap and the base member and retention of the dispensing cap on the base member, and further showing the details permitting retention of the child resistant sleeve between the base member and the dispensing cap but permitting movement of the sleeve relative to the base member and cap from a NORMAL to a READY position;

FIG. 4 is a cross-sectional elevational view similar to FIG. 3 showing the closure of FIGS. 1–3 with its child-resistant sleeve having been moved downwardly from its NORMAL position to a READY position providing access to the dispensing cap for finger movement of the cap from its closed position, shown in full line, by movement of the user's finger in the direction of the arrow to an open dispensing position illustrated by the cap shown in phantom; FIG. 4 further illustrates that when the child resistant sleeve has been moved to its READY position, an inwardly directed bead on the sleeve has snapped below the dispensing cap skirt to provide opening movement to the cap if the downward force is removed from the sleeve allowing the stored resilient force in the sleeve to act upwardly;

FIG. 5 is a sectional view taken along line 5—5 of FIG. 4 showing the details of the attachment of the closure plug to the base member;

FIG. 6 is an elevational view partially in section similar to FIG. 3 of a wider closure embodiment than the FIGS. 1–5 closures, shown in a closed, NORMAL position recessed within the child-resistant sleeve; this FIG. 6 embodiment has no self-opening head on the child-resistant sleeve;

FIG. 7 is an elevational view partially in section showing another embodiment in which the dispensing cap is recessed within the child-resistant sleeve, the sleeve further having an inwardly directed bead to create a self-opening force in a manner similar to that shown in FIG. 4;

FIG. 8 is an elevational view of another embodiment of the invention showing slotting of the child-resistant sleeve to permit easier flexure of the sleeve when it is being moved from its NORMAL to its READY position;

FIGS. 9–12 show further embodiments of the invention in which the child-resistant sleeve is tapered to coact with a cylindrical portion of the base member to introduce the resilient return force in the sleeve as it is being moved from its NORMAL position to its READY position: more particularly:

FIG. 9 is an elevational view partially in cross-section of an embodiment having a tapered or frusto-conical shaped child-resistant sleeve shown in its NORMAL position blocking access to the dispensing cap shown in its closed position recessed within the sleeve and further showing a threaded base member for attachment to a threaded container neck;

FIG. 10 is an elevational view partially in section similar to FIG. 4 showing the closure of FIG. 9 with its tapered child-resistant sleeve having been manually moved downward in the direction of the arrow to its READY position and showing the dispensing cap having been moved from its closed position, shown in phantom, in the direction of the arrow to its dispensing position by finger movement;

FIG. 11 shows another embodiment of the invention in which the tapered child-resistant sleeve is slotted to permit easier flexure than the child-resistant sleeves of FIGS. 9 and 10 and further showing a protective collar concentrically located with respect to a cylindrical base portion: the collar having an open portion permitting easy access for downward movement in the direction of the arrow of the child-resistant sleeve from its NORMAL to its READY position and further showing in phantom a portion of the sleeve having been moved to its READY position for movement of the dispensing cap to an open dispensing position in the direction of the arrow by a finger shown in phantom;

FIG. 12 is an elevational view of the closure taken along line 12—12 of FIG. 11;

FIG. 13 is an elevational view partially in section showing another embodiment of the invention in which the resilient return force for the child-resistant sleeve is imparted by leaf spring members integrally molded with the sleeve; and FIG. 14 is a partial plan view of the closure of FIG. 13.

Referring to FIGS. 1–3, the closure 10 is shown attached to a container 12 for dispensing a product from the container through cap orifice 14. Closure 10 includes base member 16, dispensing cap 18 and child-resistant sleeve 20.

Base member 16 has an annular top 22 with an annular skirt 24 depending from its periphery. Annular skirt 24 has an inwardly directed bead 26 at its lower end for snapping over a complimentary flange 28 on container neck 30. Nozzle or spout 32 extends upwardly from cap 22 and is provided with a cylindrical portion 34 for coaction with cap 18. Cap 18 has a button-shaped top 36 having a flat portion 38 through which the dispensing orifice 14 extends. The button-shaped top or flange 36 extends over outer skirt or cylindrical body portion 58. Cap 18 also has an inner skirt 40 depending from top 36 with an outwardly extending bead 42 at its lower end. The cylindrical portion 34 of nozzle 32 has an inwardly directed bead 44 at its end over which cap bead 42 snaps to retain the cap 18 in sliding engagement with the base member 16. Nozzle bead 44 coacts with inner cap skirt 40 to perform a sliding seal function, and cap bead 42 performs a similar sliding seal function with the inside diameter of cylindrical nozzle portion 34. Nozzle 32 has an upstanding plug 46 centrally located in cylindrical portion 34 by ribs 48, as best seen in FIG. 5. FIG. 3 shows the closure in its closed position with plug 46 blocking or sealing orifice 14. When the cap 18 is pulled upwardly and away from base member 16 shown in phantom at 18′ in FIG. 4, the closure is open and the dispensing orifice 14 is clear of plug 46. In a conventional push-pull closure of this type without the child-resistant sleeve 20 this pulling action is easily accomplished by the thumb and forefinger of the user gripping the flange or button top 36.

In the closure of the present invention child-resistant sleeve 20 is coaxially retained between cap 18 and base member 16 as the cap is assembled to the base member nozzle 32. Child-resistant sleeve 20 has a cylindrical portion 50 with a radially outwardly directed flange 52 at its lower end. In its NORMAL position, cylindrical portion 50 of sleeve 20 completely covers outer cap skirt 58 with the upper end of cylindrical sleeve portion 50 of the child-resistant sleeve 20 being flush with the button top 36 of cap 18 as best seen in FIG. 3. This effectively blocks access to cap 18 for gripping it to pull it into its open dispensing position. The smooth contour of button top 36 also does not provide a finger hold for the user. Sleeve 50 extends downwardly and contacts the frusto-conical portion 54 of nozzle 32 adjacent flange 52 in its NORMAL position. Sleeve 20 is made with a resilient deformable plastic material such as polypropylene or polyethylene. Access to the cap !8 for opening the closure is obtained by exerting a downward force on flange 52 as shown by the arrows in FIG. 4 moving the flange 52 towards or in contact with base top 22 as shown in FIG. 4. This deforms the cylindrical portion 50 as shown at 60 in FIG. 4 which introduces a return force in the child-resistant sleeve 20 which moves the sleeve 20 from its READY position of FIG. 4 to the NORMAL position of FIG. 3. Sleeve flange 52 may be slit or slotted as shown at 62 in FIGS. 1 and 2 in order to allow the cylindrical portion 50 of the sleeve to deform at 60 in an easier manner.

An inwardly directed bead or projections 56 can be provided on sleeve 50 so that when the sleeve has been moved to its READY position, the bead or projections 56 will snap over the end of outer cap skirt 58 to provide an opening action for the cap 18 when the flange 52 is released. Alternatively, the user may insert his forefinger as shown at 62 in FIG. 4 to exert an upward movement of the cap 18 in the direction of the arrow while holding the flange 52 down with the other hand. The user may also open the closure 10 with one hand by pushing the flange 52 downwardly using his thumb and middle finger to the READY position, holding it in this position and utilizing his forefinger to lift the cap 18 to its open dispensing position.

It will be apparent from the foregoing description that the child-resistant sleeve 20 is "user-friendly" since it merely requires a downward movement to move it from its NORMAL position to its READY position so that the cap 20 can be pulled upwardly to its open dispensing position. When the cap 20 is pushed downwardly to its closed position, the child resistant sleeve 20 will be returned to its NORMAL position flush with cap top 36.

In the wider version cf the closure shown in FIG. 6, the self-opening bead or projections 56 has been eliminated from the cylindrical portion 50 of the child-resistant sleeve 20. An inwardly directed bead 64 is provided close to the top of sleeve 50 against which the button top 36 of cap 18 seats.

In the embodiment of FIG. 7, the self-opening projections 56 are retained and the button top 36 of cap 18 is seated in recess 66.

In the embodiment of FIG. 8, the cylindrical portion 50 and the flange 52 is slotted at 68 to provide further ease in flexing or deforming the sleeve as it is pushed in the direction of the arrow to its READY position, as shown at 52'.

Referring to the embodiment of the invention shown in FIGS. 9 and 10, the child-resistant sleeve 20 has a sloped or frusto-conical shaped portion 50' which coacts with a cylindrical base portion 54' to introduce a plastic deformation or resilient return force into the sleeve 20 in the same manner as the coaction between a cylindrical skirt 50 and frusto-conical base portion 54 in the embodiments shown in FIGS. 1–8. In FIG. 9, the cap 18 is shown in its closed position with plug 46 sealing the orifice 14, and the button top 36 of the cap being recessed in sloped portion 50' and seated against inwardly directed bead or projections 64. Child-resistant sleeve 20 is shown in its NORMAL position, blocking opening access to cap 18. FIG. 10 shows the child-resistant sleeve 20 pushed downwardly by user's fingers 72 in the direction of the arrow to its READY position exposing the button top 36 of cap 18 for movement by finger 62 from its closed position shown in phantom at 18' to its open position shown in full line. Base member skirt 24 contains threads 70 for attachment to a container. As in the earlier embodiments, a means for attachment can take other forms, such as a snap bead connection.

In the embodiments of the closure 10 shown in FIGS. 11 and 12, the frusto-conical shaped portion 50' of the child-resistant sleeve 20 is slotted at 68' in a manner similar to the cylindrical sleeve portion of the FIG. 8 embodiment. A protective collar 74 extends upwardly from base member top 22 to concentrically surround the cylindrical base portion 54' and the lower end of sleeve 50'. This collar is discontinuous or has a gap at 76, as shown in FIG. 12, to provide finger access for moving the sleeve downwardly, in the direction of the arrow shown in FIG. 11 from its NORMAL position to its READY position. FIG. 11 shown the upper end of sleeve 50' in this READY position in phantom at 20' permitting the finger 62 to be inserted under the button top 36 for moving it upward in the direction of the arrow to its open dispensing position.

In the embodiment of the closure 10 shown in FIGS. 13 and 14, the child-resistant sleeve 20 is shown with a cylindrical portion 50 having a radially outwardly extending flange 52 at its lower end. A plurality, shown as 4, downwardly extending leaf spring members 78 are integrally molded with the flange 52 to provide the resilient return force when a downward force is exerted against the flange 52, as shown by the dashed arrow, to its READY position shown at 52'.

We claim:

1. A push-pull dispensing closure comprising:
   - a base member having means for attachment to a container;
   - a dispensing cap slidably retained on said base member and having a dispensing orifice, said cap being movable axially relative to said base member from a closed position to an open dispensing position permitting flow through said orifice; and
   - a child-resistant sleeve coaxially mounted relative to and held captive between said base member and said cap, said sleeve being axially movable relative to said base member and said cap from a NORMAL position blocking access to said cap to a READY position providing access to said cap for movement of said cap to said open dispensing position.

2. The closure according to claim 1 further including retaining means for holding said sleeve in said NORMAL position.

3. The closure according to claim 2 wherein said retaining means includes means resiliently biasing said sleeve toward said NORMAL position when it is moved toward said READY position.

4. The closure according to claim 3 wherein said sleeve is molded with a resiliently deformable plastic material, and when said sleeve is moved relative to said base member from its NORMAL position towards its READY position, the base member causes deformation of at least a portion of said sleeve, resiliently biasing said sleeve towards said NORMAL position.

5. The closure according to claim 3 wherein said sleeve is molded with a resiliently deformable plastic material and said means for resiliently biasing said sleeve includes a generally cylindrical portion on one of said sleeve and base member which coacts with a generally frusto-conical section on the other of said sleeve and base member to introduce a return force in said sleeve as said sleeve is moved from its NORMAL position towards its READY position.

6. The closure according to claim 5 wherein said sleeve is longitudinally slotted to provide ease in flexing said sleeve as it is being moved from its NORMAL position towards its READY position.

7. The closure according to claim 5 wherein said sleeve has said cylindrical portion which coacts with said frusto-conical section on said base member.

8. The closure according to claim 7 wherein said dispensing cap has a button-shaped head containing said dispensing orifice and an annular skirt depending therefrom, and said child-resistant sleeve has an inwardly directed bead projecting from said cylindrical portion which snaps over said cap skirt when said sleeve has been moved from its NORMAL position towards its READY position so that an opening force is applied to said cap by said sleeve when said sleeve is released.

9. The closure according to claim 7 wherein said child-resistant sleeve has a radially outwardly directed flange at the bottom of said cylindrical portion against which a downward force can be exerted to move said sleeve from its NORMAL position to is READY position providing access to said dispensing cap for sliding said cap to said open dispensing position permitting flow through said orifice.

10. The closure according to claim 5 wherein said sleeve has said generally frusto-conical section which coacts with said cylindrical portion on said base member.

11. The closure according to claim 10 wherein said frusto-conical shaped sleeve section is longitudinally slotted, and a collar on said base member concentrically surrounds the cylindrical portion of said base member and the lower portion of said frusto-conical sleeve section.

12. The closure according to claim 11 wherein said collar is discontinuous to provide an area for application of a downward force on said sleeve for moving said sleeve from its NORMAL to its READY position.

13. The closure according to claim 4 wherein said retaining means includes a radially outwardly directed flange on said sleeve having integrally molded downwardly extending leaf spring members which act against said base member to provide the means resiliently biasing said sleeve towards said NORMAL position when said sleeve is moved toward said READY position.

14. The closure according to claim 1 wherein said means for attachment to a container include internal threads.

15. The closure according to claim 1 wherein said means for attachment to a container includes an inwardly directed bead on said base member which coacts with a flange on said container.

16. A push-pull dispensing closure comprising:

a base member having a frusto-conical camming surface, a cylindrical spout and means for attachment to a container;

a dispensing cap slidably retained on said spout and having a dispensing orifice, said cap being movable axially relative to said spout from a closed position to an open dispensing position permitting flow through said orifice; and a child-resistant sleeve molded with a resiliently deformable plastic material coaxially mounted on said spout and held captive between said base member and said cap, said sleeve having a cylindrical portion and a radially outwardly directed flange at the bottom of said cylindrical portion against which a downward force can be exerted to axially move said sleeve relative to said base member and relative to said cap from a NORMAL position blocking access to said cap to a READY position providing access to said cap for movement of said cap to said open position, the cylindrical portion of said sleeve coacting with the frusto-conical portion of said base member to introduce a return force in said sleeve as it is moved from its NORMAL position toward its READY position.

17. The closure according to claim 16 wherein at least said flange is slotted to provide ease in flexing said sleeve as it being moved from its NORMAL position towards its READY position.

18. The closure according to claim 17 wherein said sleeve is longitudinally slotted.

19. The closure according to claim 16 wherein the cylindrical portion of said sleeve has an inwardly directed bead projection which snaps over said dispensing cap when said sleeve has been moved from its NORMAL position towards its READY position so that an opening force is applied to said cap by said sleeve when said sleeve is released.

20. A push-pull dispensing closure comprising:

a base member having a cylindrical spout and a cylindrical camming surface coaxially circumposing said spout and means for attachment to a container;

a dispensing cap slidably retained on said spout and having a dispensing orifice, said cap being movable axially relative to said spout from a closed position to an open dispensing position permitting flow through said orifice; and a generally frusto-conical shaped child-resistant sleeve molded with a resiliently deformable plastic material mounted on said spout and held captive between said base member and said cap, said sleeve being axially movable relative to said base member and relative to said cap from a NORMAL position blocking access to said cap to a READY position providing access to said cap for movement of said cap to said open dispensing position, the frusto-conical sleeve coacting with the cylindrical cam surface of said base member to introduce a return force in said sleeve as said sleeve is moved from its NORMAL position toward its READY position.

21. The closure according to claim 20 wherein said sleeve is longitudinally slotted, and further including a collar on said base member concentrically circumposing said cylindrical cam portion and the lower portion of said sleeve, said collar being discontinuous to provide an area for application of a downward force on said sleeve for moving said sleeve from its NORMAL to its READY position.

22. A push-pull dispensing closure comprising:

a base member having means for attachment to a container;

a dispensing cap slidably retained on said base member and having a dispensing orifice, said cap being movable axially relative to said base member from a closed position to an open dispensing position permitting flow through said orifice; and a child-resistant sleeve coaxially mounted relative to and held captive between said base member and said cap, said sleeve having a radially outwardly directed flange against which a downward force can be exerted to axially move said sleeve relative to said base member and relative to said cap from a NORMAL position blocking access to said cap to a READY position providing access to said cap for movement of said cap to said open dispensing position, said flange having a plurality of downwardly extending leaf spring members which act against said base member to provide means for resiliently biasing said sleeve toward said NORMAL position when said sleeve is moved toward said READY position.

23. In a push-pull dispensing closure including the following:

a base member having means for attachment to a container;

a discharge spout extending from said base member;

a plug element supported on said base member in spaced relation to said discharge spout;

a dispensing cap slidably retained on said discharge spout and having a dispensing orifice sealed by said plug when said cap is in a closed position, said cap being axially movable away from said plug from said closed position to an open position to permit flow through said discharge spout and dispensing orifice;

the improvement comprising:

a child-resistant sleeve circumposing said spout and held captive between said base member and said dispensing cap; said sleeve being axially movable relative to said base member and said dispensing cap from a NORMAL position blocking access to said cap to a READY position providing access to said cap for movement of said cap to said open position.

24. The closure according to claim 22 further including retaining means for holding said child-resistant sleeve in said NORMAL position.

25. The closure according to claim 23 wherein said retaining means includes means resiliently biasing said sleeve towards said NORMAL position when it is moved toward said READY position.

* * * * *